US009608323B1

(12) United States Patent
Berens et al.

(10) Patent No.: US 9,608,323 B1
(45) Date of Patent: Mar. 28, 2017

(54) OMNI-DIRECTIONAL ANTENNA WITH EXTENDED FREQUENCY RANGE

(71) Applicants: Peter Stuart Berens, San Diego, CA (US); David Vincent Arney, El Cajon, CA (US); Hale Bradford Simonds, Santee, CA (US); Susan Lynn Morales, San Diego, CA (US); Dennis Bermeo, San Diego, CA (US)

(72) Inventors: Peter Stuart Berens, San Diego, CA (US); David Vincent Arney, El Cajon, CA (US); Hale Bradford Simonds, Santee, CA (US); Susan Lynn Morales, San Diego, CA (US); Dennis Bermeo, San Diego, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 374 days.

(21) Appl. No.: 14/059,520

(22) Filed: Oct. 22, 2013

(51) Int. Cl.
*H01Q 13/04* (2006.01)
*H01Q 1/50* (2006.01)
*H01Q 13/02* (2006.01)

(52) U.S. Cl.
CPC ..... *H01Q 1/50* (2013.01); *H01Q 13/0283* (2013.01); *H01Q 13/04* (2013.01)

(58) Field of Classification Search
CPC ..... H01Q 9/28; H01Q 13/04
USPC ..... 343/773, 774
See application file for complete search history.

(56) References Cited

U.S. PATENT DOCUMENTS

| | | | | |
|---|---|---|---|---|
| 2,511,849 | A * | 6/1950 | Smith | H01Q 9/28 343/773 |
| 2,762,045 | A | 9/1956 | Stavis et al. | |
| 6,268,834 | B1 | 7/2001 | Josypenko | |
| 6,667,721 | B1 * | 12/2003 | Simonds | H01Q 13/10 343/773 |
| 6,845,253 | B1 | 1/2005 | Schantz | |
| 7,079,079 | B2 * | 7/2006 | Jo | H01Q 1/243 343/702 |
| 7,538,737 | B2 | 5/2009 | Black et al. | |

(Continued)

OTHER PUBLICATIONS

Schantz, Hans, "The Art and Science of Ultrawideband Antennas", 2005, pp. 203-206, Artech House, Boston/London.

*Primary Examiner* — Dameon E Levi
*Assistant Examiner* — Hasan Islam
(74) *Attorney, Agent, or Firm* — SSC Pacific Patent Office; Arthur K. Samora; Kyle Eppele

(57) ABSTRACT

An omni-directional antenna can include a feed disk, which can terminate at a feed disk apex, and a top element, which can include a nipple that terminates a top element apex. The feed disk and top element can be positioned so that the feed disk apex and the top element apex can be spaced-apart by a distance "d", which can be chosen according to the desired frequency range and cable feed impedance. The feed disk and top element can also have respective bottom conical and top conical surfaces. When the feed disk and top element are positioned, the top and bottom conical surfaces can establish a respective first predefined angle relative to a horizontal plane and a second predefined angle relative to the horizontal plane, thereby extending the antenna frequency range. The predefined angles can be chosen according to the desired frequency range of operation and cable feed impedance.

5 Claims, 5 Drawing Sheets

(56) References Cited

U.S. PATENT DOCUMENTS

| | | | | |
|---|---|---|---|---|
| 7,764,236 | B2 * | 7/2010 | Hill | H01Q 1/243 343/702 |
| 8,314,744 | B2 | 11/2012 | Libonati et al. | |
| 8,576,135 | B1 * | 11/2013 | Krivokapic | H01Q 1/2258 343/773 |
| 2006/0284779 | A1 | 12/2006 | Parsche et al. | |
| 2007/0241980 | A1 * | 10/2007 | Smith | H01Q 9/28 343/773 |
| 2012/0044119 | A1 * | 2/2012 | Libonati | H01Q 9/28 343/807 |

* cited by examiner

OMNI-DIRECTIONAL ANTENNA WITH EXTENDED FREQUENCY RANGE

FEDERALLY-SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil, referencing NC 101630.

FIELD OF THE INVENTION

The present invention pertains generally to antennas. More specifically, the present invention pertains to the design of antennas that extend the frequency range of antennas.

BACKGROUND OF THE INVENTION

In order to operate over a wide frequency range, a plurality of dedicated antennas that operate in specific radio frequency bands are typically installed on, for example, shipboard systems. For example, ultra high frequency (UHF) antennas that operate in the range of 225 MHz to 400 MHz may be installed on the shipboard system for use by radios operating in this range. Other antennas operating in other bands may also be provided for radios operating in those other bands, resulting in an "antenna farm" on the ship. However, antennas in the antenna farm may electrically interfere with each other and create holes in the antenna pattern. To minimize the electrical interference while maintaining the frequency range, it is therefore desirable to eliminate the number of antennas by combining multiple antennas.

One way to do this is by using bi-cone antennas. However, the classic bi-cone configuration can be too large (given the physical space available) for the required lowest frequency range. A current broadband antenna that can be used for a number of communication systems while maintaining a minimal size can be limited to 8.09 GHz because of the feed point design. Accordingly, there can be a need for a broadband antenna with an extended frequency range that allows other antennas to be eliminated from the antenna farm.

SUMMARY OF THE INVENTION

Some embodiments can be directed to an antenna that can include a feed disk, which can terminate at a feed disk apex, and a top element, which can include a nipple that terminates a top element apex. The feed disk and top element can be positioned so that the feed disk apex and the top element apex can be spaced-apart by a distance "d", which can be chosen according to the desired frequency range. The feed disk and top element can also have respective bottom conical and top conical surfaces. When the feed disk and top element are positioned as described above, the top and bottom conical surfaces can establish a respective first predefined angle relative to a horizontal plane and a second predefined angle relative to the horizontal plane, thereby extending the antenna frequency range. The predefined angles can be chosen according to the desired frequency range of operation.

Other objects, advantages and features will become apparent from the following detailed description when considered in conjunction with the accompanied drawings.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
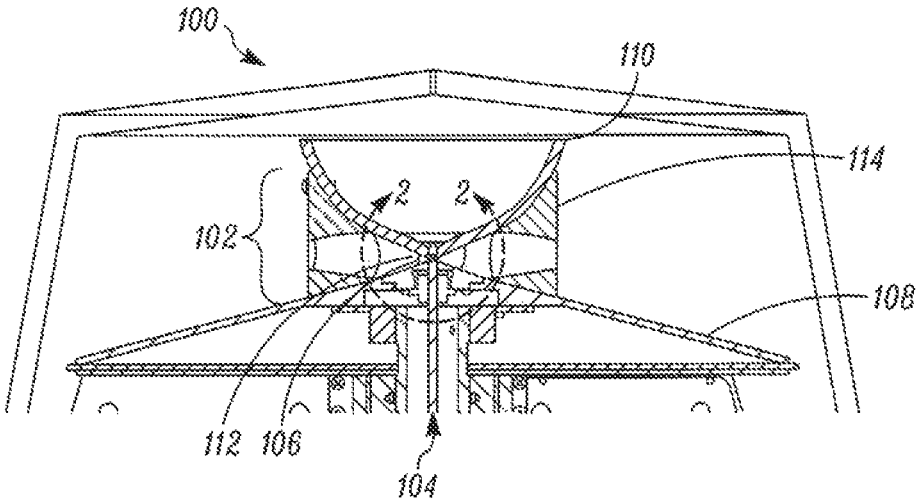
FIG. 1 is a cross sectional view of an antenna used in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE EMBODIMENTS

FIG. 1 can be a cross sectional view of an antenna used in accordance with some embodiments. Antenna 100 can be a broadband antenna with an extended frequency range from, for example, 8.09 GHz to 18 GHz. In order for a broadband antenna to operate over broad bandwidth, the impedance of the antenna must closely match the impedance of the antenna feed. Such an antenna feed can be typically an input from a 50 Ohms coaxial cable. The antenna impedance depends on the details near the feed point, wherein the impedance can be optimized by changing the shape of the region near the feed point. At high frequencies, because the angle of the feed point can determine the impedance of the antenna, the details of the feed point may affect the impedance matching of antenna 100.

Antenna 100 incorporates a bi-conical antenna configuration 102 and can include a pair of coaxially disposed cones 108 and 110, each of which has an apex region and a base. Cones 108 and 110 are arranged such that the apex regions are adjacent. Antenna 100 can be feed from the bottom with a coaxial feed cable 104. A relatively small diameter cable may be used to reduce the feed point in order to optimize higher frequency impedance matching. In an embodiment, the impact of the feed cable 104 may be reduced by using, for example, a 0.144" diameter coaxial cable. With such a feed point cable 104, antenna 100 may operate at a frequency of 18 GHz with a wavelength of 0.6562". Smaller RF Cables 104 in diameter can allow the invention to go even higher in frequency above 18 GHz.

Figure 2:
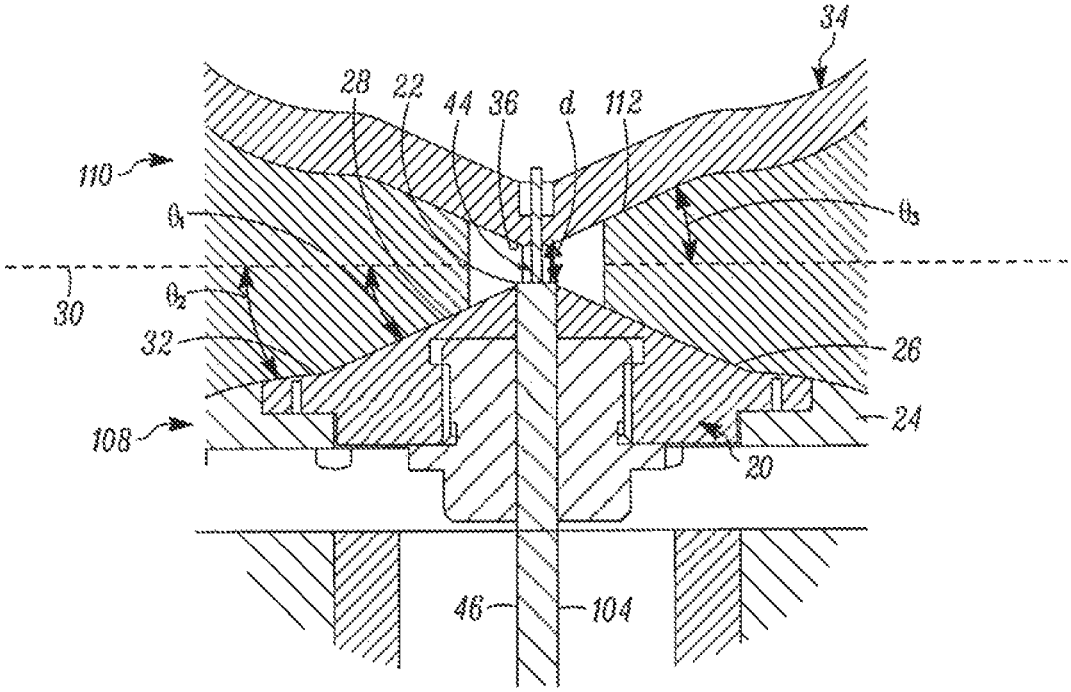
FIG. 2 is a greatly enlarged cross-sectional view of the feed disk, spacer and top elements portion of the antenna, taken along line 2-2 of FIG. 1.
Figure 4:
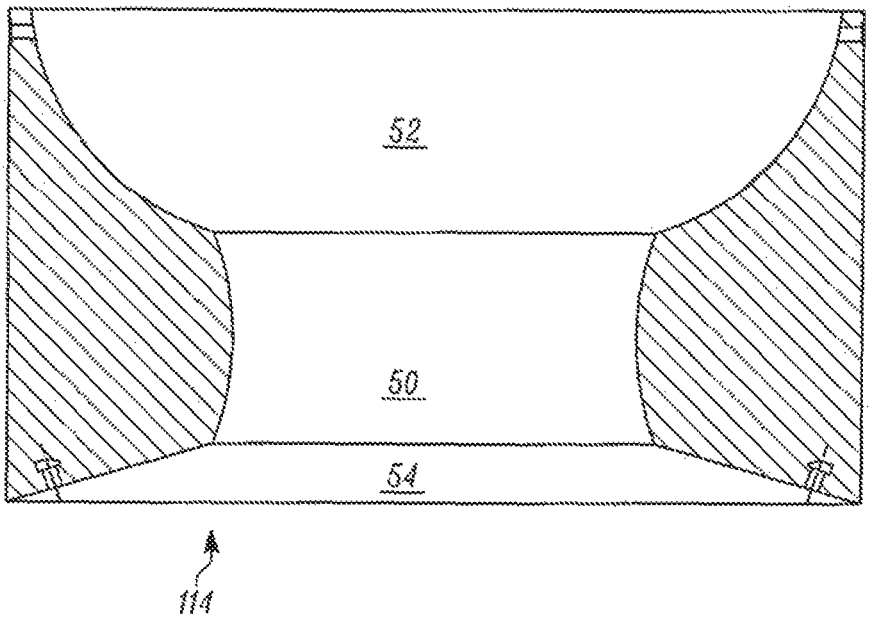
FIG. 4 is a cross sectional view of the spacer for the antenna of FIG. 1, according to several embodiments.
Figure 5:
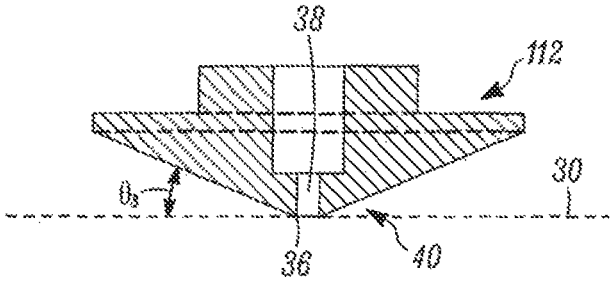
FIG. 5 is a cross-sectional view of the nipple of the top element portion of the antenna of FIG. 1.
Figure 6:
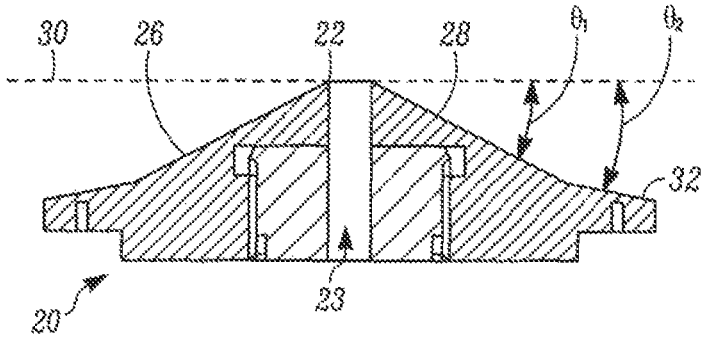
FIG. 6 is a cross sectional view of the feed disk portion for the antenna of FIG. 1.

Referring now to FIGS. 2 through 6, the feed point geometry for the antenna according to several embodiments can be shown in greater detail. As shown in FIGS. 2 and 6, cone 108 can include a feed disk 20 that can terminate at feed disk apex 22. As perhaps best seen in FIG. 6, feed disk 20 can be formed with a hole 23 for receiving ground cable 104. Hole 23 can be sized so that outer conductor 46 of feed cable can be in electrical contact with feed disk 20, as shown in FIG. 2. A ground element 24 can be attached to feed disk 20, as shown in FIG. 2. Feed disk 20 can have a bottom conical surface 26. Surface 26 can have a first portion 28 that can establish an angle $\theta_1$ from horizontal plane 30, as shown in FIGS. 2 and 6. First portion 28 can merge into second portion 32, which can further establish an angle $\theta_2$ from horizontal plane 30. In several embodiments, $\theta_1$ can be greater than $\theta_2$.

Figure 3:
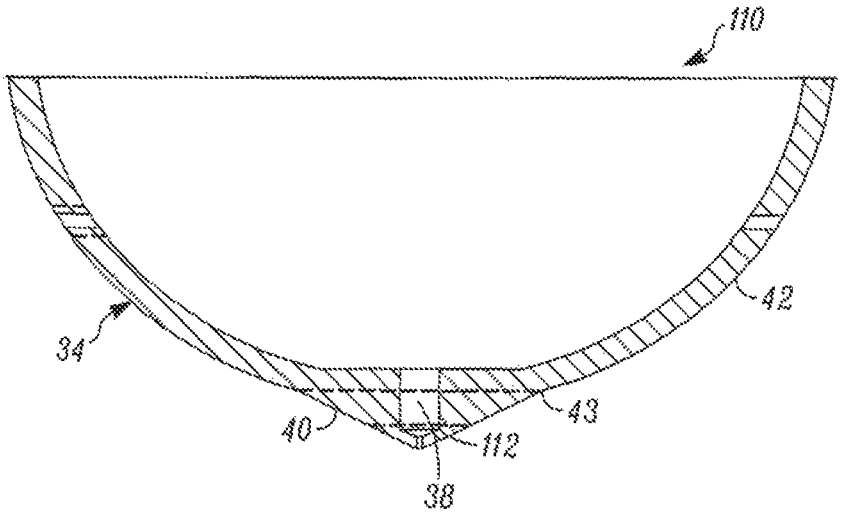
FIG. 3 is a cross sectional view of a top element used in accordance with some embodiments.

As shown in FIGS. 2, 3 and 5, cone 110 can include a top element 34. Top element can include a nipple 112 that terminates at a top element apex 36 (FIG. 5). Top element 34 can be formed with an aperture 38 for receiving feed cable 104, as described more fully below. Aperture 38 is sized so that inner conductor 44 of feed cable 104 can be in electrical contact with top element 34. Nipple 112 can merge into a log radial portion 42 for top element 34, as perhaps best seen in FIG. 3. As shown in FIG. 2, cones 108 and 110 can be oriented so that top element apex 36 and feed disk apex 22 are proximate each other and spaced-apart by a distance "d". The distance "d" can be chosen according to the desired frequency range of operation and input impedance of RF feed cable 104. Top element 34 can further have a top conical surface 40 and can merge into a log radial surface 42, as shown in FIG. 3. This smoothes the transition surface currents from surface 40 to 34, minimizing reflections. In several embodiments, top conical surface 40 can establish an angle $\theta_3$ with horizontal plane 30, as shown in FIG. 2. With this configuration geometry, the impedance of antenna 100 can be optimized when the design frequency range of the antenna is extended.

FIGS. 3 and 5 can be a cross-sectional view of a top element 34 in accordance with some embodiments. Top element 34 can have a nipple 112 that can be in electrically contact with the inner conductor 40 of cable 104. The angle of nipple 112 may differ depending on the impedance of cable 104 such that as cable 104 changes impedance, the angle of nipple 112 may change. For example, a 50 Ohms (50Ω) cable may produce a first angle, a 70 Ohms (70Ω) cable may produce a second angle, and so on, such that the matching of the feed point differs depending on the impedance of cable 104. In FIG. 5, using a RF cable with approximately 50 Ohms impedance, $\theta_3$ can be a 22.5 degrees conical angle relative to the horizontal plane 30 and the nipple diameter can be 0.750". Cone 110 can have a conical section with 27.1213 degrees relative to the horizontal. With Cable impedance and physical tolerances, these dimensions can vary. At a diameter of 1.488", the conical section can taper into a log radial surface with a radius of 2.174" at inflection point 43. The angle on the sphere can be 15.9185 degrees (relative to the horizontal) at the point of transition (inflection point 43, see FIG. 3).

A spacer 114, as shown in FIG. 1, can be axially aligned with and disposed between cones 108 and 110 and can be designed to give the precise spacing and supports between cones 108 and 110. The spacer 114 may be, for example, low-loss radio foam with a dielectric constant near 1. Referring now to FIG. 4, the structure of spacer 114 can be seen in greater detail. As shown, spacer 114 can be formed with an opening 50 that merges into an upper conical recess 52 and a lower conical recess 54. Upper conical recess 52 is shaped to conform to the shape of log radial surface 42 of top element 34 (and also top conical surface 40 when opening 50 is smaller). Similarly, lower conical radius is shaped to conform to the shape of ground element 24 (and also feed disk 24 when opening 50 is smaller). Spacer 114 can be made of a material that does not allow electromagnetic radiation in the desired frequency range to pass therethrough, such as the aforementioned RF foam, for example. Additionally, the material for spacer 114 can be chose to yield slightly, so that bottom cone 108 and top cone can be press-fit into spacer to establish the distance "d" and angles $\theta_1$, $\theta_2$ and $\theta_3$ described above, thereby extending the frequency range of antenna 100. In an embodiment, the radius of curvature of spacer 114 can be 2.708" which can be slightly smaller than the radius of cone 110, i.e., at 2.714", and the spacing "d" can be 0.031". Cone 110 can deform spacer 114 to obtain the precise feed point geometry.

The initial angle $\theta_1$ (i.e., the 22.5 degrees conical angle relative to the horizontal) can be approximated by the impedance of an infinite bi-cone according to the following Equation (1):

$$Z = (576.7/n)\ln\left(\cot\left(\frac{\theta hc}{2}\right)\right) \quad \text{Eq. (1)}$$

where $\theta_{hc}$ can be the half angle of the cone with respect to the vertical plane and n can be the desired impedance (for example, 50Ω). In the invention, CST Microwave Studio® was utilized to further optimize the angles, although other simulator tools that are known in the art could be used to further optimize the angle. For 67.5 degrees, impedance Z can be 48.3Ω. As noted above, the highest frequency of the classic bi-cone can depend on the details of the feed point. The classic bi-cone has a one wave length diameter. The impedance of the bi-cone depends on the reflection from the end of the cone. The cone can be rolled to reduce the reflections from the end of the cone.

A disk-cone antenna has one cone and a disk ground plane. The cone can be ¼ of the wavelength of the lowest frequency. A disk-cone antenna with a rolled cone has four-octave bandwidth. An embodiment replaces this cone with a section of a sphere to reduce the size and reflection from the end of the cone. The sphere section can be hollow to reduce weight.

Each time the angle changes in antenna 100, there can be a reflection and the impedance also changes. In an example where the feed point region has an initial impedance of 48.3 Ohms, at a radial distance of 0.375", the impedance will change (distance on surface can be 0.4059") causing a reflection. This will also cause a small reflection with a 0 degree phase shift plus propagation delay to feed point. In this example, a second transition to 15 degrees occurs at a radial distance of about (0.735 bottom-0.744 top; distance on surface can be 0.7956 for bottom and 0.8205 for top). This will also cause a reflection and propagation delay. The two reflected signal will modify the impedance at high frequencies. Impedance closer to 50 Ohms will have a lower Voltage Standing Wave Ratio (VSWR). The above dimensions are based on a design that meets the performance requirements for VSWR and pattern. An antenna designer could alter the design parameters and obtain similar or better performance antennas. Antenna 100 can therefore be used to transmit from 400 MHz to 18 GHz. For lower frequencies, for example, 150 MHz to 400 MHz, the antenna may be receiving only.

Figure 7:
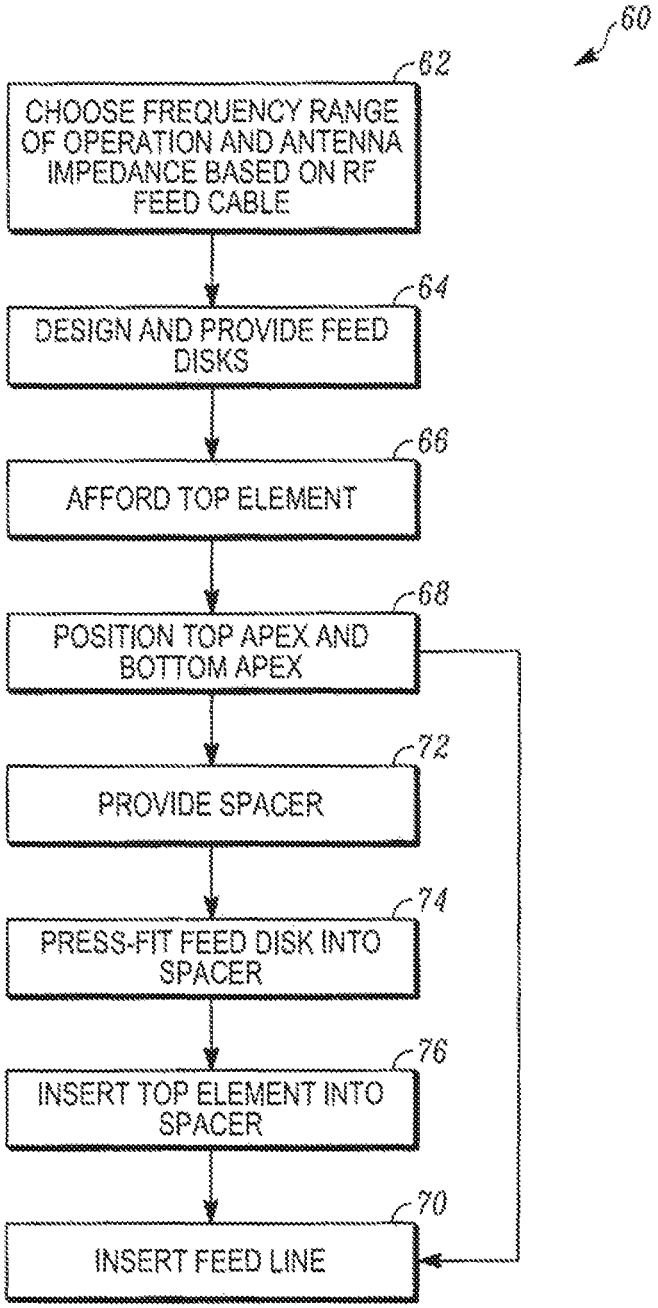
FIG. 7 is a block diagram, which illustrates steps that can be taken to practice the methods of the present invention according to several embodiments.

Referring now to FIG. 7, a block diagram 60 of steps that can be taken to accomplish the methods of several embodiments of the present invention is shown. The methods can be used to design a brand new antenna, or alternatively can be used to modify an existing antenna to extend its frequency range while at the same time using the same physical footprint of the antenna (i.e., without needing any more space). As shown, method 60 can include the initial step 62 of choosing a frequency range of operation and desired impedance. Once the frequency range is chosen, the methods can include the steps of designing feed disk 24 and a top element 34, as shown by respective blocks 64 and 66 in FIG. 7. The feed disk and top element conical surface angles from the horizontal disk and top element can be chosen according to the frequency of operation and desired impedance, using the same structure and geometry considerations as described above. As shown by step 68, the methods can also include positioning the top element apex 36 and feed disk apex 22 by a distance "d", where "d" is chosen according to the result of step 62 (the desired frequency range and impedance). Feed line 104 can be inserted into the device and described above and depicted by step 70 in FIG. 7.

As shown by step 72 in FIG. 7, a spacer 114 can optionally be used to establish distance "d" and angles $\theta_1$ and $\theta_3$. For these instances, spacer 114 can be formed with upper and lower recesses that conform to the contours of top element 34, feed disk 20 and ground element 24. As depicted by steps 72 and 74 in FIG. 7, these components can be press-fit into spacer 114 as described above, or they can be fixed to spacer with a plurality of dielectric fasteners (not shown in the Figures) such as plastic or nylon screws, etc.

It will be understood that many additional changes in the details, materials, steps and arrangement of parts, which have been herein described and illustrated to explain the nature of the invention, may be made by those skilled in the art within the principle and scope of the invention as expressed in the appended claims.

We claim:

1. A bi-cone antenna having a frequency range, the antenna comprising:

a bottom cone and a top cone;

said bottom cone having a feed disk, said feed disk having a bottom conical surface that merges into a feed disk apex, said feed disk also being formed with a hole;

said bottom conical surface having a first portion that establishes a constant angle $\theta_1$ with resect to a horizontal plane, said first portion merging outwardly from said feed disk apex into a second portion having a constant angle $\theta_2$ with resect to said horizontal plane, with said $\theta_2$ less than said $\theta_1$;

said top cone including a top element, said top element having a nipple that terminates at a top element apex, a top conical surface and a log radial surface, said top element being formed with an aperture;

a spacer axially aligned with and disposed between the feed disk and the top element to establish a distance "d" between the feed disk and the top element, said spacer being made of a material that allows said feed disk and said top element to be press-fit into said spacer;

a coaxial cable feed having an inner conductor and an outer conductor, said cable feed extending through said aperture and into said hole so that said inner conductor is in electrical contact with said top element and said outer conductor is in electrical contact with said feed disk; and, a ground element attached to said feed disk.

2. The antenna of claim 1, wherein said distance "d" is chosen according to a desired said frequency range.

3. A bi-cone antenna having a frequency range, comprising:

a top cone and a bottom cone;

a spacer formed with an upper conical recess and a lower conical recess, said upper and lower conical recesses merging into an opening;

said bottom cone having a feed disk, said feed disk attached to said spacer said feed disk being formed with a hole and having a bottom conical surface that terminates at a bottom apex, said bottom conical surface being in contact with said lower conical recess;

said bottom conical surface having a first portion that establishes a constant angle $\theta_1$ with respect to a horizontal plane, said first portion merging outwardly from said apex of said feed disk into a second portion having a constant angle $\theta_2$ with respect to said horizontal plane, with said $\theta_2$ less than said $\theta_1$;

said top cone having a top element attached to said spacer, said top element being formed with an aperture and having a top conical surface and a nipple that terminates at a top apex, said top element being in contact with said upper conical recess, said top conical surface establishing an angle $\theta_3$ with said horizontal plane;

a coaxial feed line having an inner conductor and an outer conductor, said opening, said hole and said aperture cooperating to establish an conduit for insertion of said feed line so that said inner conductor being in electrical contact with said top element, said outer conductor being in electrical contact with said feed disk;

a ground element attached to said feed disk; and, said spacer positioning said top apex and said bottom apex apart by a distance "d" that is chosen according to a desired said frequency range.

4. The antenna of claim 3 wherein said spacer is made of a material that allows said feed disk and said top element to be press-fit into said spacer to establish said distance "d".

5. A method for extending the frequency range of an bi-cone antenna, comprising the steps of:

A) choosing a frequency range of operation, a coaxial feed line having an inner conductor and an out conductor, and an impedance;

B) providing a bottom cone having a feed disk, said feed disk being formed with a hole and having a bottom conical surface that terminates at a bottom apex;

B1) forming said bottom conical surface with a first portion and a second portion, said first portion establishing a constant angle $\theta_1$ with respect to a horizontal plane, said first portion merging outwardly from said apex of said feed disk into said second portion, said second portion having a constant angle $\theta_2$ with respect to said horizontal plane, so that said $\theta_2$ is less than said $\theta_1$;

C) affording a top cone with a top element, said top element being formed with an aperture and having a top conical surface and a nipple that terminates at a top apex;

D1) providing a spacer formed with an upper conical recess, a lower conical recess and an opening;

D2) press-fitting said feed disk into said lower conical recess;

D3) inserting said top element into said top conical recess to establish a distance "d"

said distance "d" being chosen according to the results of said step A);

E) inserting an antenna feed line through said hole, said opening and said aperture so that said inner conductor electrically contacts said top element and said outer conductor electrically contacts said feed disk; and, F) attaching a ground element to said feed disk.

* * * * *